US006783335B2

(12) United States Patent
Chang

(10) Patent No.: US 6,783,335 B2
(45) Date of Patent: Aug. 31, 2004

(54) LINEAR COMPRESSOR HAVING AN ANTI-COLLISION DEVICE

(75) Inventor: Keun-Sik Chang, Osan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 41 days.

(21) Appl. No.: 10/157,845

(22) Filed: May 31, 2002

(65) Prior Publication Data

US 2003/0099558 A1 May 29, 2003

(30) Foreign Application Priority Data

Nov. 27, 2001 (KR) ..... 2001-74200

(51) Int. Cl.[7] ..... F04B 17/04
(52) U.S. Cl. ..... 417/417; 92/130 B; 92/130 C
(58) Field of Search ..... 417/417, 416, 417/415; 92/13, 60.5, 130 B, 130 C, 131, 169.1

(56) References Cited

U.S. PATENT DOCUMENTS 5,275,542 A * 1/1994 Terauchi ..... 417/417
5,525,045 A * 6/1996 Jang ..... 417/284
6,077,054 A 6/2000 Lee et al. ..... 417/417
6,084,320 A * 7/2000 Morita et al. ..... 310/12
6,203,292 B1 * 3/2001 Morita et al. ..... 417/417
6,540,490 B1 * 4/2003 Lilie ..... 417/416
6,644,945 B2 * 11/2003 Lilie et al. ..... 417/571

FOREIGN PATENT DOCUMENTS

JP 9-324750 * 12/1997

* cited by examiner

*Primary Examiner*—Charles G. Freay
(74) *Attorney, Agent, or Firm*—Staas & Halsey LLP

(57) ABSTRACT

A linear compressor with an anti-collision device, which prevents a piston of the compressor from being brought into collision with a cylinder head and/or a suction valve even when the piston moves past an upper dead center position during an operation of the compressor. In one aspect, the anti-collision device may include a resonant spring, an elastic member spaced apart from the resonant spring, and a shock absorbing member having a central hole and set in the central opening of the elastic member. The central hole of the shock absorbing member may be tapered in a direction toward the cylinder head to have a first tapered surface, and the movable member may be tapered at a portion between the resonant spring and the anti-collision device, thus having a second tapered surface corresponding to the tapered surface of the central hole. Alternatively, the anti-collision device may include a first tapered surface formed on a skirt part of a cylinder by tapering the skirt part such that a diameter of a first tapered surface is reduced in a direction toward the cylinder head, and a second tapered surface formed on the piston so as to correspond to the first tapered surface of the cylinder.

13 Claims, 8 Drawing Sheets

LINEAR COMPRESSOR HAVING AN ANTI-COLLISION DEVICE

CROSS-REFERENCE TO RELATED APPLICATIONS

This application claims the benefit of Korean Application No. 2001-74200 filed Nov. 27, 2001, in the Korean Patent Office, the disclosure of which is incorporated herein by reference.

BACKGROUND OF THE INVENTION

1. Field of the Invention

The present invention relates, in general, to linear compressors for refrigerating systems and air conditioning systems, such as refrigerators and air conditioners, and, more particularly, to a linear compressor provided with an anti-collision device preventing a movement of a piston, which exceeds an upper dead center position of a piston inside a cylinder.

2. Description of the Prior Art

As is well known to those skilled in the art, a compressor is a machine that sucks and compresses the gas refrigerant in a refrigerating system or an air conditioning system, such as a refrigerator or an air conditioner, operated by performing a refrigeration cycle. Compressors have been typically classified into two types: reciprocating compressors and rotary compressors. The reciprocating compressors compress the gas refrigerant by a rectilinear reciprocation of a piston, while the rotary compressors compress the gas refrigerant by rotation of one or more vanes. A linear compressor is a type of reciprocating compressor, and linearly reciprocates a piston using a linear motor to compress the gas refrigerant Such a linear compressor has low energy loss, thus being high in energy efficiency in comparison with the other type of compressors.

FIGS. 1 and 2 are side sectional views, showing the construction of a conventional linear compressor. FIG. 1 shows the linear compressor when a piston is positioned at a stop position, and FIG. 2 shows the compressor when the piston is positioned at an upper dead center position.

As shown in FIGS. 1 and 2, the conventional linear compressor comprises a drive unit 10 and a compressing unit 20, which are housed in a hermetic casing 1. The drive unit 10 generates drive power when electricity is applied from an external power source, while the compressing unit 20 sucks the gas refrigerant and compresses the gas refrigerant using the drive power transmitted from the drive unit 10.

The compressing unit 20 comprises a hollow cylinder 21 defining a compressing chamber 22 in a cylindrical bore with a cylinder head 23 assembled including an end of the hollow cylinder 21 which guides the suction and the discharge of the gas refrigerant. A piston 24 is movably received in the compressing chamber 22 of the hollow cylinder 21, and linearly reciprocates in the compressing chamber 22 using the drive power transmitted from the drive unit 10.

The drive unit 10, which is a type of linear motor, comprises a cylindrical white iron assembly 11 arranged around the hollow cylinder 21. A core 12, wound with a coil 13, is arranged such that the core 12 and coil 13 surround the iron assembly 11 with an annular gap defined between the iron assembly 11 and the core 12. When an alternating current AC is applied to the coil 13 of the core 12, the core 12 generates a magnetic flux. A magnet 14 is positioned in the gap formed between the iron assembly 11 and the core 12 such that the magnet 14 reciprocates along with the piston 24.

The core 12 is fabricated by closely layering a plurality of steel sheets, and is supported by both the hollow cylinder 21 and a support frame 21*a*. The magnet 14 is mounted to a movable member 25 integrated with the piston 24 into a single structure, and linearly reciprocates in cooperation with the magnetic flux generated by the core 12. Due to the linear reciprocating action of the magnet 14, the piston 24 reciprocates in the hollow cylinder 21.

Both the drive unit 10 and the compressing unit 20 are elastically suspended in the hermetic casing 1 by a plurality of coil springs 2 elastically supporting the hollow cylinder 21 at a lower portion inside the hermetic casing 1. A plurality of spacers 4 vertically extends upward from an upper surface of the support frame 21*a* of the hollow cylinder 21 to the same height. A resonant spring 3, which is a type of plate spring, is mounted to ends of the spacers 4. The movable member 25, which is integrated with the piston 24 into the single structure and reciprocates by the drive unit 10, is mounted at an end to the center of the resonant spring 3. The piston 24 linearly reciprocates in the hollow cylinder 21 by both the resonant spring 3 and the movable member 25, thus sucking the gas refrigerant into the hermetic casing 1 and compressing the refrigerant prior to discharging the compressed gas refrigerant from the hermetic casing 1.

The cylinder head 23 has a suction chamber 6 and an exhaust chamber 8. The suction chamber 6, which is provided with a suction valve 5, guides the gas refrigerant from the outside of the hermetic casing 1 into the compressing chamber 22. The exhaust chamber 8, which is provided with an exhaust valve 7, guides the compressed gas refrigerant from the compressing chamber 22 to the outside of the hermetic casing 1.

When an alternating current AC is applied to the coil 13 of the drive unit 10, the coil 13 generates a magnetic flux. This magnetic flux of the coil 13 cooperates with the magnetic field of the magnet 14, which is mounted to the movable member 25, thus allowing the movable member 25 to reciprocate in a vertical direction while vibrating the resonant spring 3. The piston 24 thus linearly reciprocates in the cylinder 21. When the piston 24 moves from a stop position of FIG. 1 to a lower dead center position during a reciprocating action, the suction valve 5 is opened to suck the gas refrigerant from the suction chamber 6 into the compressing chamber 22. When the piston 24 moves to a upper dead center position as shown in FIG. 2, the suction valve 5 is closed and the exhaust valve 7 is opened to discharge the compressed gas refrigerant from the compressing chamber 22 to the exhaust chamber 8.

The natural frequency of the resonant spring 3 according to the mass of the piston 24, magnet 14 and movable member 25 is set to be almost equal to the frequency of the alternating current AC applied to the coil 13 of the core 12, and the drive unit 10 can generate high drive power caused by resonance. The amplitude of both the reciprocating piston 24 and the movable member 25 is regulated by controlling the applied voltage. In such a case, to allow the piston 24 to stably reciprocate with a predetermined amplitude, a separate control unit (not shown) capable of stably controlling the amplitude of the piston 24 can be provided.

In such a conventional linear compressor, the volumetric efficiency of the compressor varies in accordance with a gap volume determined by a minimum gap distance Xc between the cylinder head 23 and the upper dead center position of the piston 24. That is, higher volumetric efficiency of the linear compressor can be obtained as the minimum gap distance Xc is reduced. Therefore, when high volumetric efficiency of the compressor is desired, reducing the gap volume as much as possible by controlling the amplitude of the piston 24 such that the piston 24 can approach close to the cylinder head 23 and the suction valve 5 during an operation of the compressor is preferable.

However, during a reciprocating action of the piston in the cylinder of the conventional linear compressor, the behavior of the piston may become unstable, thereby abruptly and rapidly increasing the amplitude of the piston due to unexpected internal or external causes, such as unexpected rapid variation in the applied voltage or unexpected rapid variation in the pressure of the refrigeration cycle. When the amplitude of the piston rapidly increases as described above, the end of the piston may come into collision with the suction valve and/or the cylinder head, thus generating operational noise, in addition to causing serious damage and breakage to the cylinder head, the suction valve, the exhaust valve and/or the piston.

SUMMARY OF THE INVENTION

Accordingly, a linear compressor for refrigerating systems and air conditioning systems is provided with an anti-collision device preventing a movement of a piston, which exceeds an upper dead center position of the piston in a cylinder, and thereby prevents the piston from colliding with a suction valve and/or a cylinder head, in addition to attenuating the impact caused by such an excessive movement of the piston.

Additional objects and advantages of the invention will be set forth in part in the description which follows and, in part, will be obvious from the description, or may be learned by practice of the invention.

In order to accomplish the above and other objects, the present invention provides a linear compressor comprising a cylinder, a cylinder head assembled with the cylinder and having at least one valve, a piston received in the cylinder, and a drive unit reciprocating the piston, and further comprising an anti-collision device preventing the piston from moving past the upper dead center position of the piston and thereby preventing the piston from colliding with the cylinder head and the valve.

In a first embodiment, a plurality of spacers extend from a support frame of the cylinder, a resonant spring is perpendicularly mounted to the spacers, a movable member extends from the end of the piston and is assembled at an end of the movable member with a central portion of the resonant spring and is reciprocated by the drive unit, and the anti-collision device is mounted to the spacers while being spaced apart from the resonant spring by a predetermined gap.

In the first embodiment, the anti-collision device comprises: an elastic member mounted to the spacer and provided with a central opening having a predetermined size, and a shock absorbing member set in a central opening of the elastic member, the shock absorbing member having a central hole and being fitted over the movable member at the central hole such that the movable member reciprocates through the central hole.

In the linear compressor, the distance between the shock absorbing member of the anti-collision device and the resonant spring is preferably set to be almost equal to a value calculated by subtracting a minimum gap distance between the cylinder head and the piston when the piston is positioned at an upper dead center position from a distance between the cylinder head and the piston when the piston is in a stop position.

In a second embodiment, the central hole of the shock absorbing member is tapered in a direction toward the cylinder head, thus having a first tapered surface, and the movable member is tapered at a portion thereof between the resonant spring and the anti-collision device, thus having a second tapered surface corresponding to the tapered surface of the central hole.

In such a case, the axial distance between the tapered surface of the shock absorbing member and the tapered surface of the movable member is preferably set to be almost equal to the value calculated by subtracting the minimum gap distance between the cylinder head and the piston when the piston is positioned at the upper dead center position from the distance between the cylinder head and the piston when the piston is in the stop position.

In a third embodiment, the anti-collision device comprises: a first tapered surface formed on a skirt part of the cylinder by tapering the skirt part such that the diameter of the first tapered surface is reduced in a direction toward the cylinder head; and a second tapered surface formed on the piston so as to correspond to the tapered surface of the cylinder.

In such a case, the axial distance between the tapered surface of the cylinder and the tapered surface of the piston is preferably set to be almost equal to the value calculated by subtracting the minimum gap distance between the cylinder head and the piston when the piston is positioned at the upper dead center position from the distance between the cylinder head and the piston when the piston is in the stop position.

BRIEF DESCRIPTION OF THE DRAWINGS

These and other objects and advantages of the invention will become apparent and more readily appreciated from the following description of the preferred embodiments, taken in conjunction with the accompanying drawings of which:

FIGS. 1 and 2 are side sectional views, showing the internal construction of a conventional linear compressor, in which: FIG. 1 shows the linear compressor when a piston is positioned at the stop position, and FIG. 2 shows the compressor when the piston is positioned at the upper dead center position;

FIGS. 3 and 4 are side sectional views, showing the internal construction of a linear compressor having an anti-collision device according to the first embodiment of the present invention, in which: FIG. 3 shows the linear compressor of this invention when a piston is positioned at the stop position, and FIG. 4 shows the compressor when the piston is positioned at the upper dead center position;

FIGS. 5 and 6 are side sectional views, showing the internal construction of a linear compressor having an anti-collision device according to the second embodiment of the present invention, in which: FIG. 5 shows the linear compressor of this invention when a piston is positioned at the stop position, and FIG. 6 shows the compressor when the piston is positioned at the upper dead center position; and FIGS. 7 and 8 are side sectional views, showing the construction of a linear compressor having an anti-collision device according to the third embodiment of the present invention, in which: FIG. 7 shows the linear compressor of this invention when a piston is positioned at the stop position, and FIG. 8 shows the compressor when the piston is positioned at the upper dead center position.

DETAILED DESCRIPTION OF THE INVENTION

Figure 1:
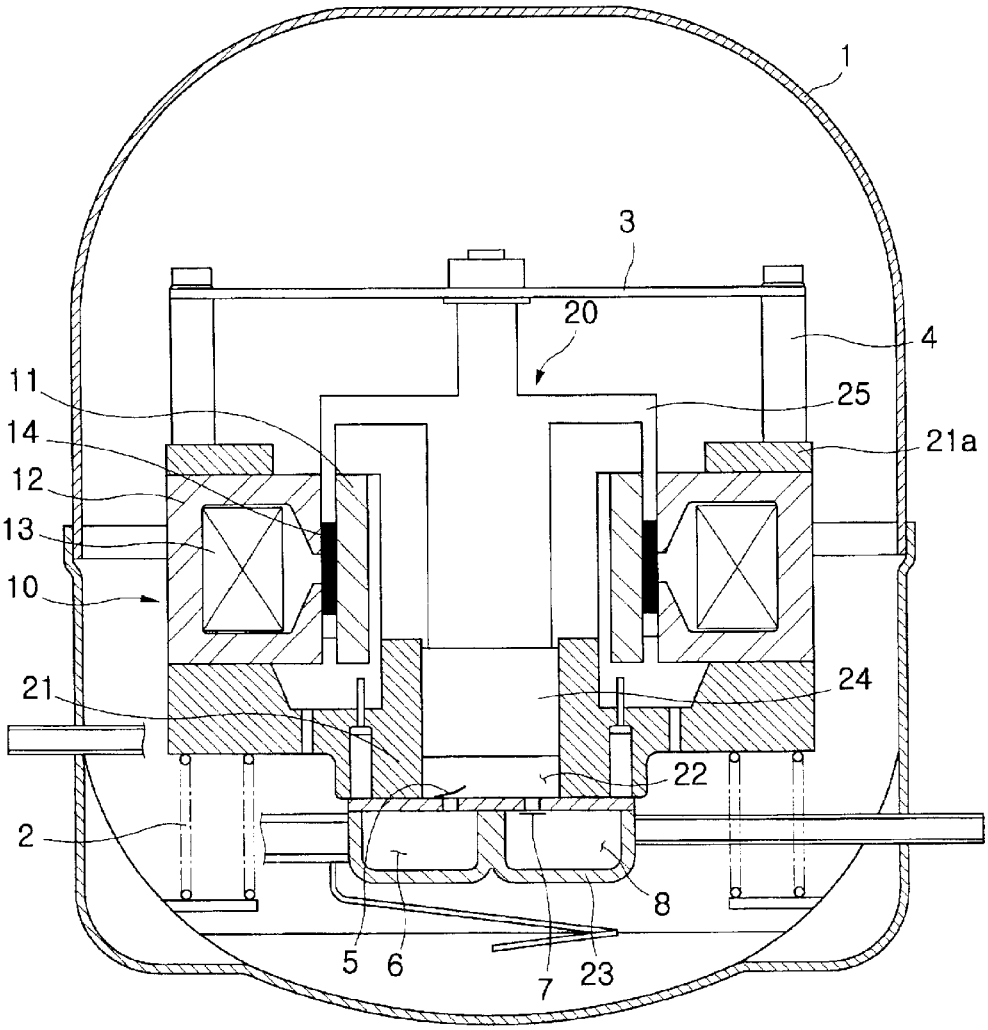
FIG. 1 (Prior Art)
Figure 2:
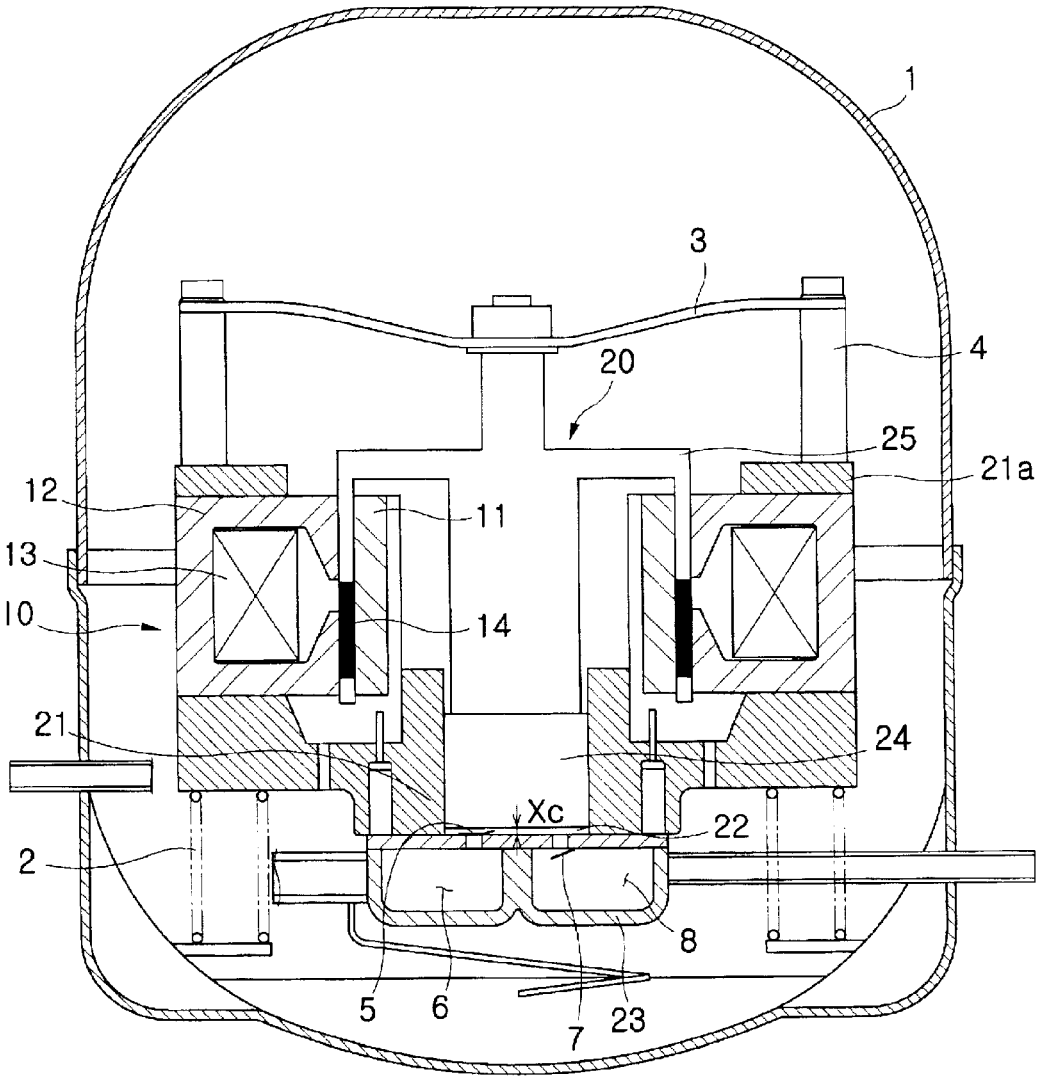
FIG. 2 (Prior Art)

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
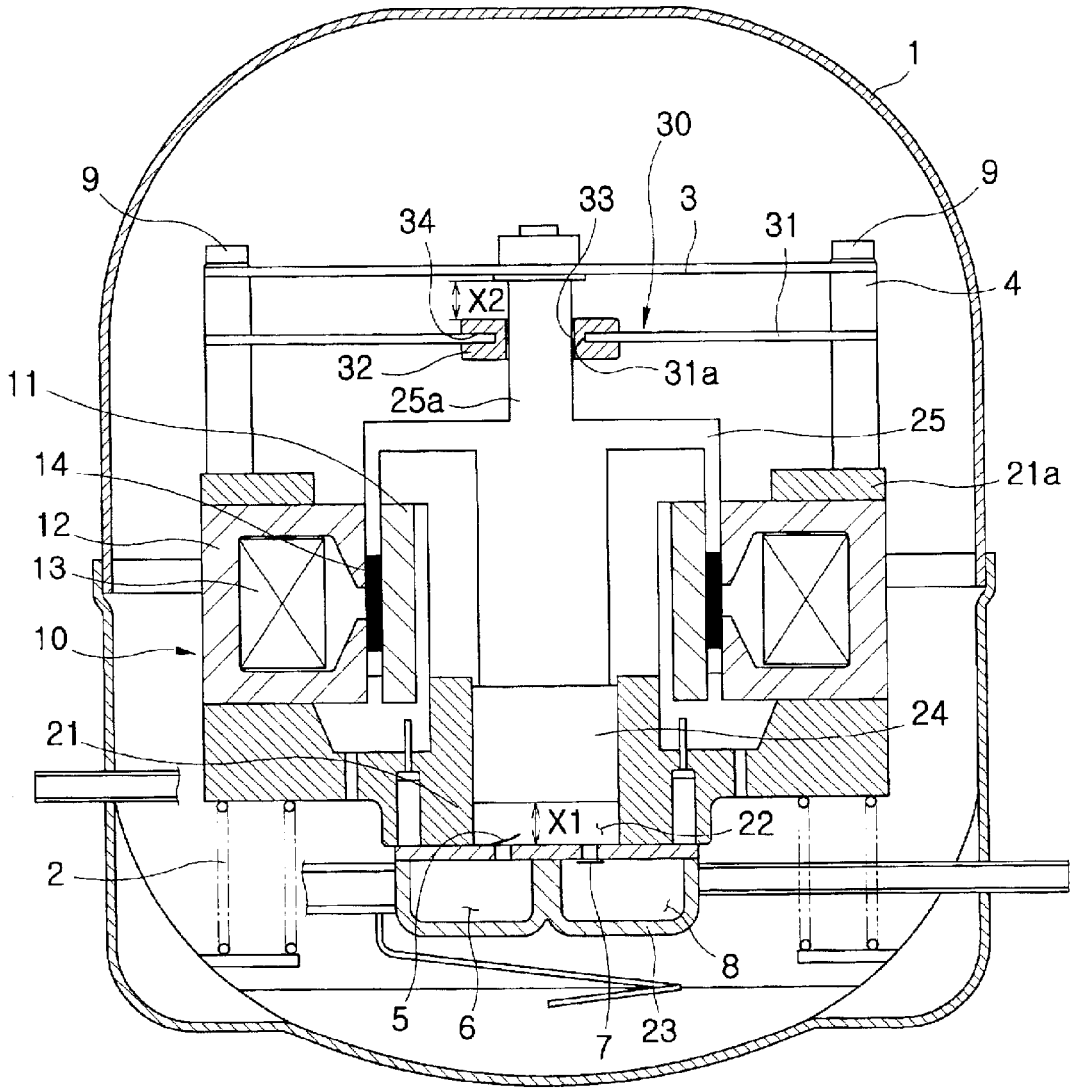
Figure 4:
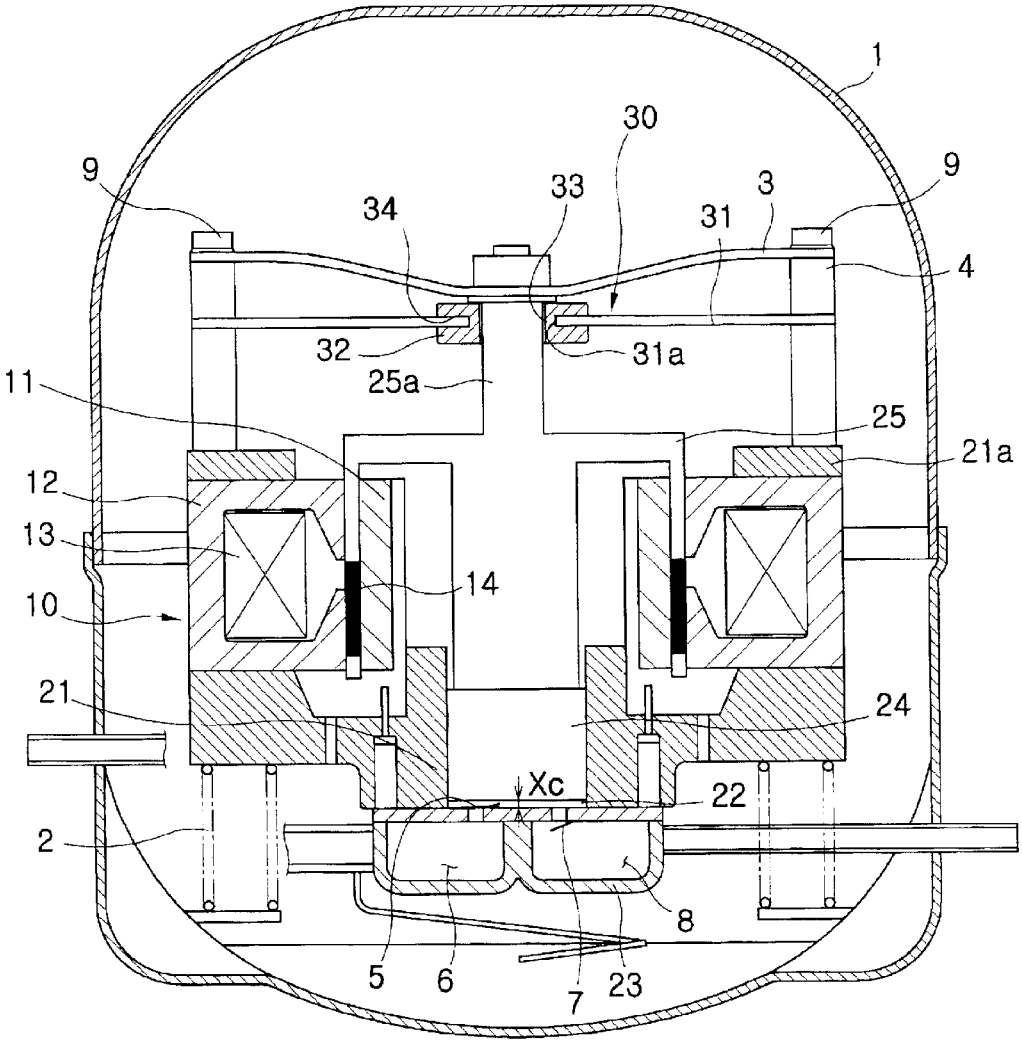

FIGS. 3 and 4 are side sectional views, showing the internal construction of a linear compressor having an anti-collision device according to the first embodiment of the present invention. In the drawings, FIG. 3 shows the linear compressor of this invention when a piston is positioned at a stop position, and FIG. 4 shows the compressor when the piston is positioned at an upper dead center position.

The linear compressor having an anti-collision device 30 according to the first embodiment of this invention comprises a drive unit 10 and a compressing unit 20, which are housed in a hermetic casing 1. This compressor sucks, compresses and discharges the gas refrigerant during an operation of a system performing a refrigeration cycle.

The compressing unit 20 comprises a hollow cylinder 21 defining a compressing chamber 22 with a cylinder head 23 assembled including an end of the cylinder 21. A piston 24 is movably received in the compressing chamber 22 of the hollow cylinder 21, such that the piston 24 reciprocates in the compressing chamber 22. The compressing unit 20 also has a support frame 21*a*, which is mounted to the hollow cylinder 21, a plurality of upward extending spacers 4, a resonant spring 3, which is perpendicularly mounted to the ends of the spacers 4, a movable member 25 extending from the piston 24 and mounted to the center of the resonant spring 3.

The cylinder head 23 has a suction chamber 6 and an exhaust chamber 8. The suction chamber 6 guides the gas refrigerant from the outside of the hermetic casing 1 into the compressing chamber 22. The exhaust chamber 8 guides the compressed gas refrigerant from the compressing chamber 22 to the outside of the hermetic casing 1. The suction chamber 6 is provided with a suction valve 5 at an outlet port, through which the chamber 6 communicates with the compressing chamber 22. The exhaust chamber 8 is provided with an exhaust valve 7 at an inlet port, through which the chamber 8 communicates with the compressing chamber 22.

The drive unit 10 comprises a cylindrical white iron assembly 11 arranged around the hollow cylinder 21. A core 12, wound with a coil 13, is mounted to the support frame 21*a* while surrounding the iron assembly 11 with an annular gap defined between the iron assembly 11 and the core 12. A magnet 14 is mounted to the movable member 25, and is positioned in a gap formed between the iron assembly 11 and the core 12, and reciprocates along with the piston 24.

Both the drive unit 10 and the compressing unit 20 are elastically suspended in the hermetic casing 1 by a plurality of coil springs 2 elastically supporting the hollow cylinder 21 at a lower portion inside the hermetic casing 1.

The anti-collision device 30 according to the first embodiment comprises an elastic member 31, which has a central opening 31*a*, and is perpendicularly mounted to the spacers 4 while being spaced apart from the resonant spring 3 by a predetermined gap. A shock absorbing member 32 is set in the central opening 31*a* of the elastic member 31.

The elastic member 31 is a type of plate spring preferably made of a high strength elastic material, which allows the elastic member 31 to effectively resist the impact applied thereto, in the case of a collision against the resonant spring 3 when the elastic member 31 is subject to slight elastic deformation. The elastic member 31 and the resonant spring 3 are mounted to the spacers 4 at the same time by a plurality of setscrews 9 axially threaded into the spacers 4 at the ends of the spacers 4.

The shock absorbing member 32 may be elastically deformed, while absorbing the impact applied from the spring 3 thereto, when the member 32 collides with the resonant spring 3. In order to accomplish the above object, the shock absorbing member 32 is preferably made of rubber or a synthetic resin. The shock absorbing member 32 has an annular slit 34 formed around the circumferential surface thereof, and the shock absorbing member 32 is set in the central opening 31*a* of the elastic member 31 by fitting the inside edge of the elastic member 31 into the annular slit 34. The shock absorbing member 32 also has a central hole 33, and is fitted over a connection bar 25*a* of the movable member 25 at the central hole 33. The end of the connection bar 25*a* is mounted to the center of the resonant spring 3 using a bolt.

As described above, the anti-collision device 30 according to the first embodiment is perpendicularly mounted to the spacers 4 while being spaced apart from the resonant spring 3 by a predetermined gap. In addition, the connection bar 25*a* of the movable member 25 is fitted into the central hole 33 of the shock absorbing member 32 prior to being mounted to the center of the resonant spring 3. Therefore, the movable member 25 linearly reciprocates, and the resonant spring 3 is vibrated in the hermetic casing 1.

As shown in FIG. 3, a distance X2 between the shock absorbing member 32 of the anti-collision device 30 and the resonant spring 3 at the stop position of the piston 24 is set to be almost equal to the value calculated by subtracting the minimum gap distance Xc between the cylinder head 23 and the end of the piston 24 when the piston 24 is positioned at the upper dead center position, as shown in FIG. 4, from a distance X1 between the cylinder head 23 and the end of the piston 24 when the piston 24 is in the stop position, as shown in FIG. 3. Therefore, when the piston 24 moves past the upper dead center position, the shock absorbing member 32 comes into contact with the resonant spring 3, thus absorbing shock and preventing the piston 24 from colliding with the suction valve 5 of the cylinder head 23.

The operation of the linear compressor according to the first embodiment will be described herein below.

When an alternating current AC is applied to the coil 13 of the drive unit 10, the coil 13 generates a magnetic flux. This magnetic flux of the coil 13 cooperates with the magnetic field of a magnet 14, which is mounted to the movable member 25, thus allowing the movable member 25 to reciprocate in a vertical direction while vibrating the resonant spring 3. Thus, the piston 24 linearly reciprocates in the hollow cylinder 21. When the piston 24 moves from the stop position of FIG. 3 to the lower dead center position during the reciprocating action, the suction valve 5 is opened to suck the gas refrigerant from the suction chamber 6 into the compressing chamber 22. In such a case, the resonant spring 3 is spaced apart from the shock absorbing member 32 by a maximum distance (X2+dilatational displacement). The dilatational displacement means the distance by which the piston moves from the initial position to the lower dead center position.

When the piston 24 moves to the upper dead center position, as shown in FIG. 4, the resonant spring 3 moves to be adjacent to the shock absorbing member 32. In addition, the piston 24 moves toward the cylinder head 23 until the piston approaches the cylinder head 23 with a minimum gap distance Xc left between the piston 24 and the cylinder head 23 to prevent the piston 24 from colliding with the suction valve 5 or the cylinder head 23. By this action, the suction valve 5 is closed and the exhaust valve 7 is opened to discharge the compressed gas refrigerant from the compressing chamber 22 to the exhaust chamber 8. The above-mentioned operation is repeated to suck the gas refrigerant into the hermetic casing 1, and to compress the refrigerant prior to discharging the compressed gas refrigerant from the hermetic casing 1.

When an applied voltage or pressure of the gas refrigerant during an operation of the compressor is unexpectedly changed, the piston 24 may move past the upper dead center position, and collide with the suction valve 5 and/or the cylinder head 23. However, the linear compressor of the present invention overcomes such a problem since the shock absorbing member 32 of the anti-collision device 30 comes into contact with the resonant spring 3 and absorbs the shock. In addition, the elastic member 31 restricts an excessive movement of the resonant spring 3 toward the cylinder head 23, thus preventing the piston 24 from colliding with the cylinder head 23. Therefore, this linear compressor accomplishes a smooth reciprocating action of the piston 24. When the resonant spring 3 is brought into contact with the shock absorbing member 32, the elastic member 31 is elastically and finely deformed such that the elastic member 31 does not affect the minimum gap distance Xc, and absorbs the shock.

Figure 5:
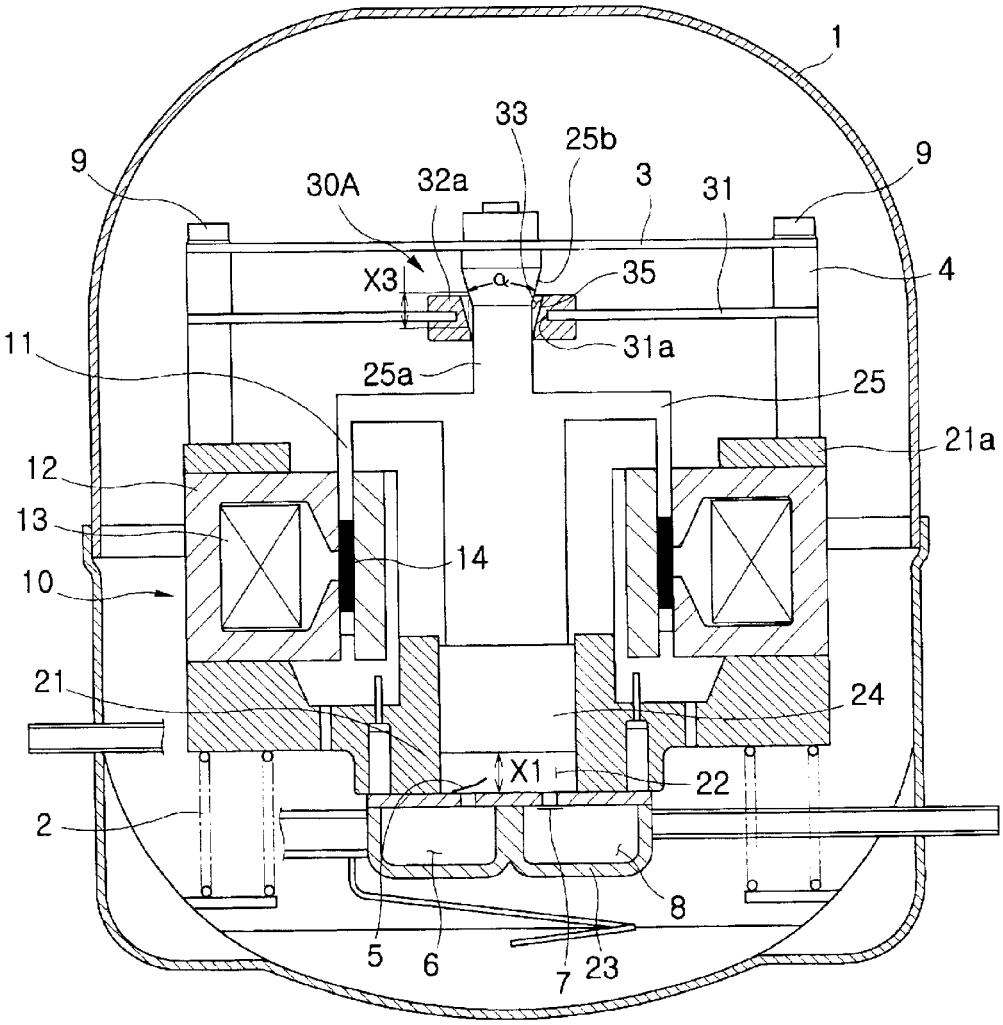
Figure 6:
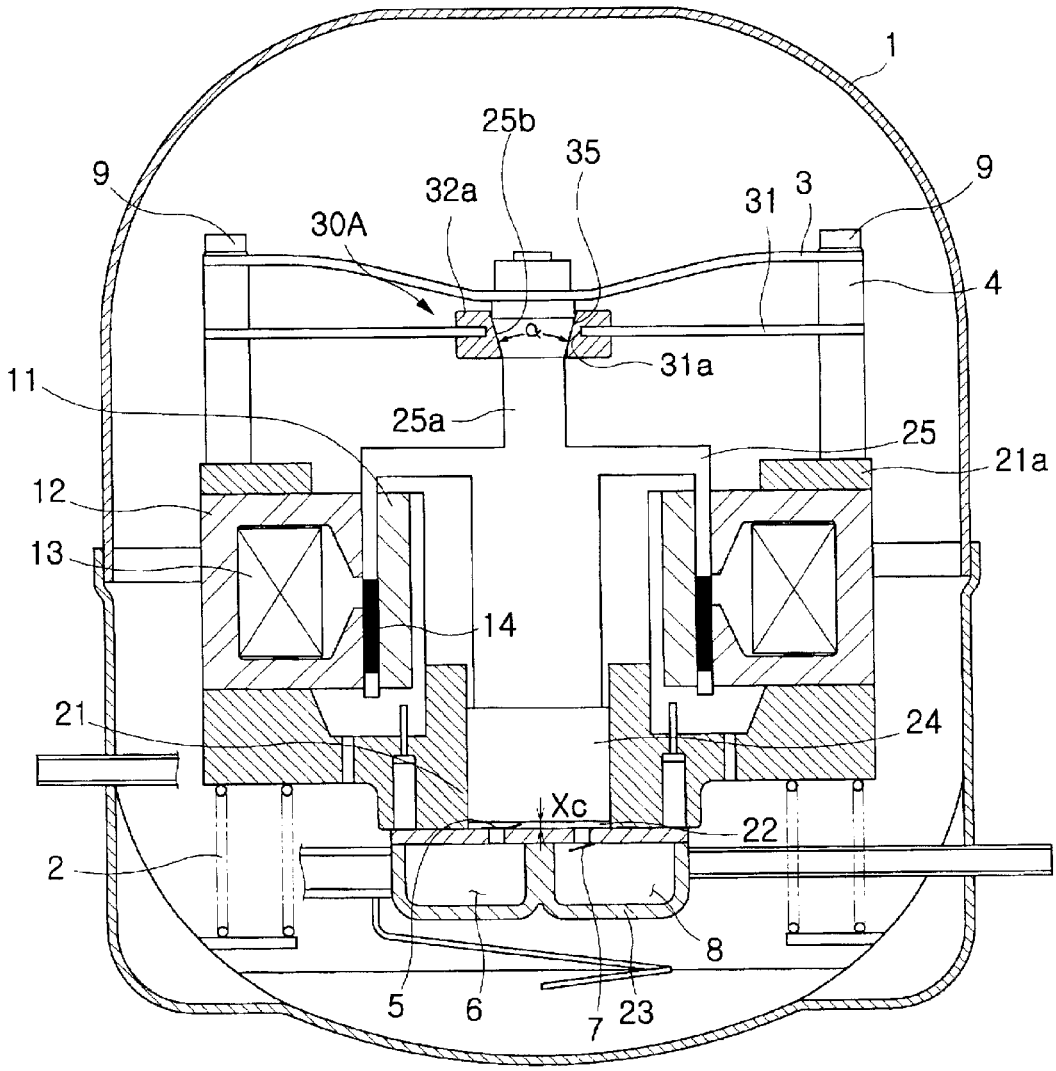

FIGS. 5 and 6 are side sectional views, showing the internal construction of a linear compressor having an anti-collision device according to a second embodiment of the present invention. That is, FIG. 5 shows the linear compressor when the piston is positioned at the stop position, and FIG. 6 shows the compressor when the piston is positioned at the upper dead center position.

As shown in FIGS. 5 and 6, the general shape of the linear compressor according to the second embodiment remains the same as in the first embodiment, but some elements of the anti-collision device 30A are altered. Therefore, those elements common to both the first and second embodiments are not described in detail in the following description.

In the same manner as that described for the anti-collision device 30 according to the first embodiment of the invention, an anti-collision device 30A according to the second embodiment comprises an elastic member 31, which has a central opening 31 a and is perpendicularly mounted to spacers 4 while being spaced apart from a resonant spring 3 by a predetermined gap. A shock absorbing member 32*a* is set in the central opening 31*a* of the elastic member 31.

The elastic member 31 and the resonant spring 3 are mounted to the spacers 4 at the same time by a plurality of setscrews 9 axially threaded into the spacers 4 at the ends of said spacers 4. The shock absorbing member 32*a* has an annular slit 34 formed around the circumferential surface, and is set in the central opening 31*a* of the elastic member 31 by fitting an inside edge of the elastic member 31 into the annular slit 34. The elastic member 31 may be mounted to the spacers 4 by means of another locking method in place of the screwing method.

The shock absorbing member 32*a* has a central hole 33, and is fitted over a connection bar 25*a* of the movable member 25 at the central hole 33 in the same manner as that described for the first embodiment. However, in the second embodiment, the central hole 33 of the shock absorbing member 32*a* is tapered in a direction toward the cylinder head 23, thus having a first tapered surface 35. In order to meet the tapered configuration of the central hole 33, a part of the connection bar 25*a* of the movable member 25 is tapered at a position around the resonant spring 3, thus having a second tapered surface 25*b*. Therefore, when the central portion of the resonant spring 3 is moved in a direction toward the upper dead center position of the piston 24, the tapered surface 25*b* of the movable member 25 is guided by the tapered surface 35 of the shock absorbing member 32*a*.

In the second embodiment of the present invention, two tapered surfaces 25*b* and 35 are provided such that the two tapered surfaces 25*b* and 35 are prevented from being wedged or jammed when the tapered portion of the connection bar 25*a* is completely seated in the tapered central hole 33 of the shock absorbing member 32*a*. In order to accomplish the above object, the angle a of each of the tapered central hole 33 and the tapered portion of the connection bar 25*a* is preferably set to 90° or more. On the other hand, when a shock absorbing effect is desired a wedging action of the two tapered surfaces, the tapered central hole 33 and the tapered portion of the connection bar 25*a* may be designed to have the same angle of less than 90° or different angles. However, in this case, the two tapered surfaces 25*b* and 35 should have a high degree of smoothness and should be precisely processed.

The anti-collision device 30A of the second embodiment is perpendicularly mounted to the spacers 4 while being spaced apart from the resonant spring 3 by a predetermined gap. The connection bar 25*a* of the movable member 25 is fitted into the tapered central hole 33 of the shock absorbing member 32*a* prior to being mounted to the center of the resonant spring 3. Therefore, the movable member 25 linearly reciprocates, and the resonant spring 3 is vibrated in the hermetic casing 1. When the piston 24 is in the stop position, as shown in FIG. 5, the tapered surface 25*b* of the connection bar 25*a* of the movable member 25 is positioned to be spaced apart from the tapered surface 35 of the tapered central hole 33 of the shock absorbing member 32*a* by a predetermined gap.

As shown in FIG. 5, the axial distance X3 between the tapered surface 35 of the shock absorbing member 32*a* and the tapered surface 25*b* of the connection bar 25*a* at the stop position of the piston 24 is set to be almost equal to the value calculated by subtracting the minimum gap distance Xc between the cylinder head 23 and the end of the piston 24 when the piston 24 is positioned at the upper dead center position, as shown in FIG. 6 from the distance X1 between the cylinder head 23 and the end of the piston 24 when the piston 24 is in the stop position, as shown in FIG. 5. Therefore, when the piston 24 moves past the upper dead center position, the tapered surface 25*b* of the movable member 25 comes into contact with the tapered surface 35 of the shock absorbing member 32*a*, thus absorbing the shock and preventing the piston 24 from colliding with the suction valve 5 and/or the cylinder head 23.

In the second embodiment of the present invention, the anti-collision device 30A more effectively attenuates the impact caused by collision in comparison with the anti-collision device 30 of the first embodiment due to the shock absorbing action of the two tapered surfaces 25*b* and 35. The anti-collision device 30A of the second embodiment also further reduces operational noise caused by a collision of the connection bar 25*a* of the movable member 25 with the shock absorbing member 32*a*.

In the second embodiment, the operational distance X3 of the anti-collision device 30A is an axial distance between the tapered surface 25*b* of the movable member 25 and the tapered surface 35 of the shock absorbing member 32*a*. As described above, the tapered portion of the connection bar 25*a* and the tapered center hole 33 of the shock absorbing member 32*a* are designed such that the two tapered surfaces 25*b* and 35 have the same angle or that the tapered surface 25*b* of the movable member 25 has a slightly smaller angle than the tapered surface 35 of the shock absorbing member 32*a*.

The operational effect of the linear compressor according to the second embodiment remains the same as that described for the first embodiment, and further explanation is thus not deemed necessary.

Figure 7:
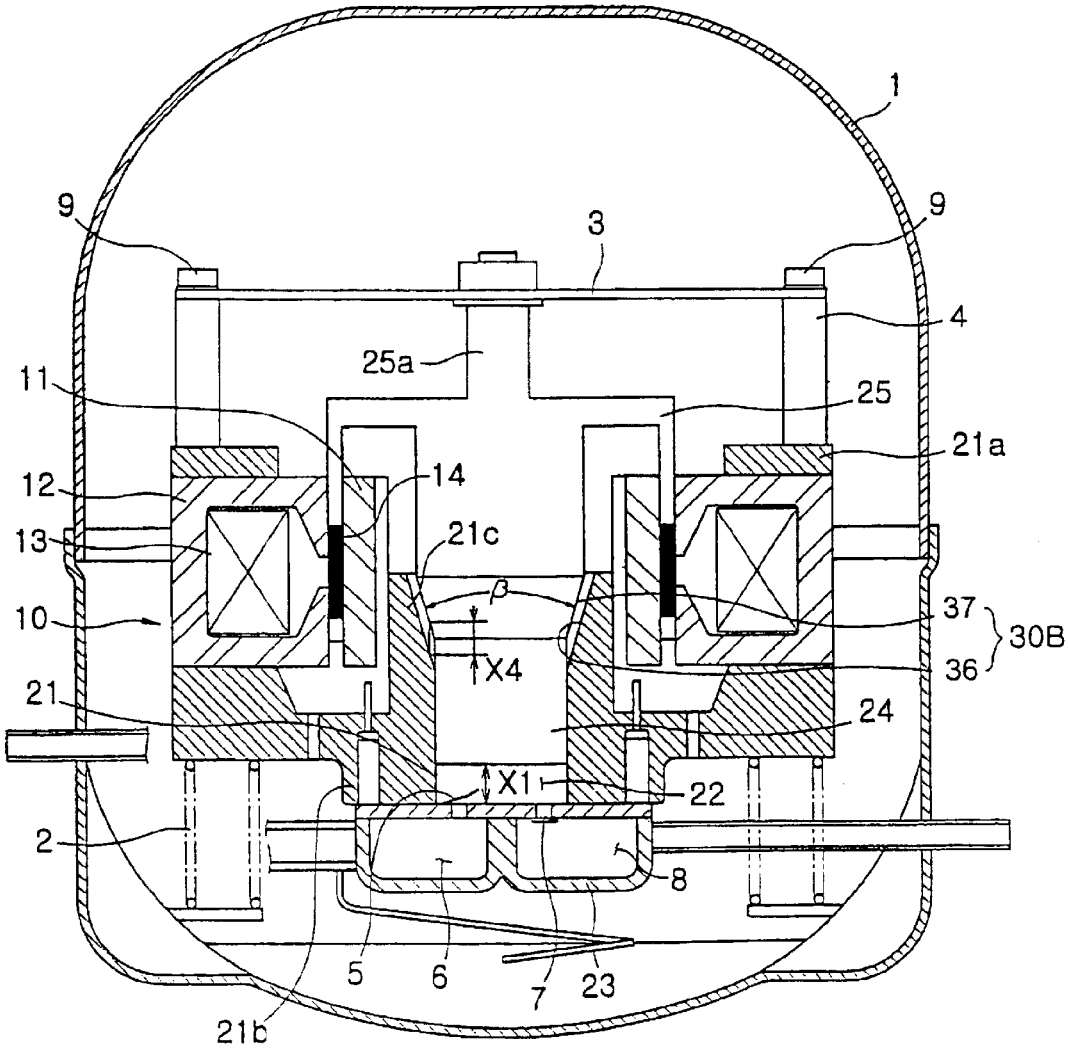
Figure 8:
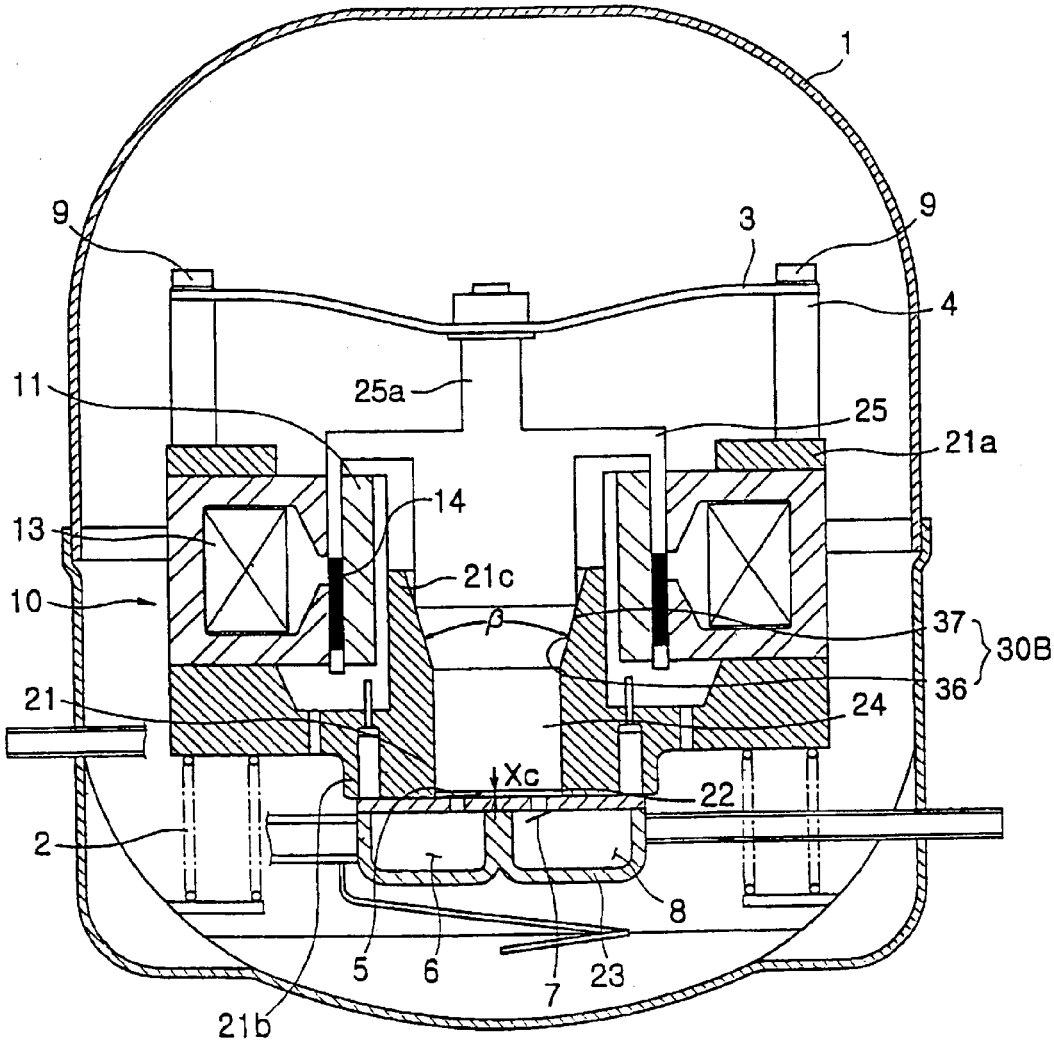

FIGS. 7 and 8 are side sectional views, showing the internal construction of a linear compressor having an anti-collision device according to a third embodiment of the present invention. That is, FIG. 7 shows the linear compressor when the piston is positioned at the stop position, and FIG. 8 shows the compressor when the piston is positioned at the upper dead center position.

As shown in FIGS. 7 and 8, the anti-collision device 30B of the linear compressor according to the third embodiment is designed to prevent collision of the piston 24 with the suction valve 5 and/or the cylinder head 23 using a shock absorbing action of two tapered surfaces in a similar manner to that described for the first embodiment. That is, the anti-collision device 30B of the third embodiment comprises a first tapered surface 36 formed at a skirt part 21*c* of the hollow cylinder 21. The skirt part 21*c* is positioned opposite to the head part 21*b* of the hollow cylinder 21. The anti-collision device 30B has a second tapered surface 37, which is provided on the piston 24 at the junction of the piston 24 and the movable member 25 for meeting the tapered surface 36 of the hollow cylinder 21. Therefore, when the central portion of the resonant spring 3 is moved in a direction toward the upper dead center position of the piston 24, the second tapered surface 37 of the piston 24 is guided by the first tapered surface 36 of the hollow cylinder 21. When the piston 24 is in the stop position as shown in FIG. 7, the second tapered surface 37 of the piston 24 is positioned to be spaced apart from the tapered surface 36 of the hollow cylinder 21 by a predetermined gap.

As shown in FIG. 7, an axial distance X4 between the second tapered surface 37 of the piston 24 and the tapered surface 36 of the hollow cylinder 21 at the stop position of the piston 24 is set to be almost equal to the value calculated by subtracting the minimum gap distance Xc between the cylinder head 23 and the end of the piston 24 when the piston 24 is positioned at the upper dead center position, as shown in FIG. 8, from the distance X1 between the cylinder head 23 and the end of the piston 24 when the piston 24 is in the stop position, as shown in FIG. 7. Therefore, when the piston 24 moves past the upper dead center position, the second tapered surface 37 of the piston 24 comes into contact with the tapered surface 36 of the hollow cylinder 21, thus absorbing shock and preventing the piston 24 from colliding with the suction valve 5 and/or the cylinder head 23.

In the third embodiment, the tapered surface 36 and the second tapered surface 37 are, respectively formed on the piston 24 and the hollow cylinder 21, both of which are made of metal. Therefore, the two tapered surfaces 36 and 37 should to be designed such that the two tapered surfaces 36 and 37 are prevented from being wedged or jammed together and do not transmit excessive impact to each other. In order to accomplish the above object, the angle "β" of each of the two tapered surfaces 36 and 37 is preferably set to 60°~120°. In addition, the two tapered surfaces 36 and 37 should have a high degree of smoothness almost equal to that of the circumferential surface of the piston 24 and should be precisely processed.

The anti-collision device 30B of the third embodiment is somewhat problematic in that an impact higher than that of the first or second embodiments is generated during an operation of the linear compressor. However, the anti-collision device 30B is advantageous in that the anti-collision device 30B most effectively, easily and stably restricts the collision of the piston 24 with the cylinder head 23 within the minimum gap distance Xc and is of a simple construction, thereby reducing the production cost of linear compressors.

The operational effect of the linear compressor according to the third embodiment remains the same as that described for the first embodiment, and further explanation is thus not deemed necessary.

As described above, the present invention provides a linear compressor having an anti-collision device. The anti-collision device prevents the piston of the compressor from being brought into collision with the cylinder head and/or the suction valve when the piston moves past the upper dead center position during an operation of the linear compressor. Therefore, the piston, the cylinder head and the suction valve can be prevented from breaking. The anti-collision device also remarkably reduces the operational noise and the collision impact during the operation of the linear compressor.

In a conventional linear compressor, a substantial gap between the piston and the cylinder head is maintained to allow a safe operation when the piston is in the upper dead center position, and so the volumetric efficiency of the conventional linear compressor is limited. Therefore, when high refrigeration capacity of a system using a conventional linear compressor is desired, the linear compressor must be enlarged in size, increasing production cost. However, the linear compressor having the anti-collision device of the embodiments of the present invention substantially prevents a collision of the piston with the suction valve and/or the cylinder head during an operation, thus minimizing the gap between the piston and the cylinder head. Therefore, the linear compressor of the embodiments of the present invention has improved operational performance and improved volumetric efficiency without enlarging the size of the linear compressor.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A linear compressor having a cylinder, a cylinder head assembled with the cylinder and having at least one valve, a piston received in said cylinder, and a drive unit reciprocating said piston, the linear compressor comprising:

an anti-collision device preventing the piston from moving past an upper dead center position of the piston to prevent the piston from colliding with the cylinder head and the valve;

a resonant spring mounted with the piston and reciprocating with the piston such that when the piston reaches the upper dead center position, the resonant spring comes into contact with the anti-collision device;

a spacer extending from an end of said cylinder, the resonant spring being perpendicularly mounted to said spacer; and a movable member extending from an end of said piston, being assembled with a central portion of the resonant spring and being reciprocated by said drive unit, and said anti-collision device being mounted to the spacer while being spaced apart from the resonant spring by a predetermined gap, when the piston is not reciprocating wherein said anti-collision device comprises:

an elastic member mounted to said spacer and provided with a central opening having a predetermined size; and a shock absorbing member set in said central opening of the elastic member, said shock absorbing member having a central hole and being fitted over the movable member at said central hole such that the movable member reciprocates through the central hole.

2. The linear compressor according to claim 1, wherein said elastic member comprises a plate shape.

3. The linear compressor according to claim 1, wherein a distance between said shock absorbing member of the anti-collision device and said resonant spring is set to be substantially equal to a value calculated by subtracting a minimum gap distance between the cylinder head and the piston when the piston is positioned at the upper dead center position from a distance between the cylinder head and the piston when the piston is in a stop position.

4. The linear compressor according to claim 1, wherein the central hole of the shock absorbing member is tapered in a direction toward the cylinder head forming a first tapered surface, and the movable member is tapered at a portion between the resonant spring and the anti-collision device forming a second tapered surface corresponding to the first tapered surface of the central hole.

5. The linear compressor according to claim 4, wherein an axial distance between the second tapered surface of the shock absorbing member and the first tapered surface of the movable member is set to be substantially equal to a value calculated by subtracting a minimum gap distance between the cylinder head and the piston when the piston is positioned at the upper dead center position from a distance between the cylinder head and the piston when the piston is in a stop position.

6. A linear compressor having a cylinder, a cylinder head assembled with the cylinder and having at least one valve, a piston received in said cylinder, and a drive unit reciprocating said piston, the linear compressor comprising:

an anti-collision device preventing the piston from moving past an upper dead center position of the piston to prevent the piston from colliding with the cylinder head and the valve, wherein said anti-collision device comprises:

a first tapered surface formed on a skirt part of the cylinder such that a diameter of the first tapered surface is reduced in a direction toward the cylinder head; and a second tapered surface formed on said piston so as to correspond to the first tapered surface of the cylinder.

7. The linear compressor according to claim 6, wherein an axial distance between the first tapered surface of the cylinder and the second tapered surface of the piston is set to be substantially equal to a value calculated by subtracting a minimum gap distance between the cylinder head and the piston when the piston is positioned at the upper dead center position from a distance between the cylinder head and the piston when the piston is in a stop position.

8. A linear compressor having a cylinder, a cylinder head assembled with the cylinder and having at least one valve, a piston received in said cylinder, and a drive unit reciprocating said piston, the linear compressor comprising:

an anti-collision device preventing the piston from moving past an upper dead center position of the piston to prevent the piston from colliding with the cylinder head and the valve, wherein said anti-collision device comprises:

a spacer extending from an end of said cylinder;

an elastic member mounted to said spacer with a central opening having a predetermined size;

a shock absorbing member set in said central opening of the elastic member and having a central hole, the shock absorbing member tapering in a direction toward the cylinder head forming a first tapered surface; and a movable member reciprocating through the central hole, attached to the piston, fitted inside and contacting the shock absorbing member when the piston is positioned at an upper dead center position and having a second tapered surface substantially corresponding to the first tapered surface of the shock absorbing member.

9. The linear compressor according to claim 8, wherein a resonant spring is perpendicularly mounted to said spacer and is reciprocated with the movable member.

10. The linear compressor according to claim 8, wherein an axial distance between the second tapered surface of the shock absorbing member and the first tapered surface of the movable member is set to be substantially equal to a value calculated by subtracting a minimum gap distance between the cylinder head and the piston when the piston is positioned at the upper dead center position from a distance between the cylinder head and the piston when the piston is in a stop position.

11. A linear compressor having a cylinder, a cylinder head assembled with the cylinder and having at least one valve, a piston received in said cylinder, and a drive unit reciprocating said piston, the linear compressor comprising:

an anti-collision device preventing the piston from moving past an upper dead center position of the piston to prevent the piston from colliding with the cylinder head and the valve, wherein said anti-collision device comprises:

a spacer extending from an end of said cylinder, an elastic member mounted to said spacer with a central opening having a predetermined size;

a shock absorbing member set in said central opening of the elastic member and having a central hole, the shock absorbing member tapering in a direction toward the cylinder head forming a first tapered surface; and a movable member reciprocating through the central opening and having a second tapered surface with a different tapering angle then the first tapered surface of the shock absorbing member, wherein both the first and second tapered surfaces are tapered in a same direction.

12. The linear compressor according to claim 11, wherein a resonant spring is perpendicularly mounted to said spacer and is reciprocated with the movable member.

13. The linear compressor according to claim 11, wherein an axial distance between the second tapered surface of the shock absorbing member and the first tapered surface of the movable member is set to be substantially equal to a value calculated by subtracting a minimum gap distance between the cylinder head and the piston when the piston is position from a distance between the cylinder head and the position.

* * * * *

UNITED STATES PATENT AND TRADEMARK OFFICE

CERTIFICATE OF CORRECTION

PATENT NO. : 6,783,335 B2
DATED : August 31, 2004
INVENTOR(S) : Keun-sik Chang

It is certified that error appears in the above-identified patent and that said Letters Patent is hereby corrected as shown below:

Column 12,
Line 42, delete "," insert -- ; -- after "cylinder"
Line 64, change "position" to -- positioned at the upper dead center position --.

Signed and Sealed this

Third Day of May, 2005

JON W. DUDAS
*Director of the United States Patent and Trademark Office*